US005437370A

United States Patent [19]

Marco

[11] Patent Number: 5,437,370

[45] Date of Patent: Aug. 1, 1995

[54] PACKAGE COMPRISING CONTAINERS IN UNITIZED UPPER AND LOWER TIERS

[75] Inventor: Leslie S. Marco, Bloomingdale, Ill.

[73] Assignee: Illinois Tool Works Inc., Glenview, Ill.

[21] Appl. No.: 238,421

[22] Filed: May 5, 1994

[51] Int. Cl.[6] ..... B65D 75/00

[52] U.S. Cl. ..... 206/430; 206/427; 206/150

[58] Field of Search ..... 206/150, 151, 427, 429, 206/430

[56] References Cited

U.S. PATENT DOCUMENTS

| | | | |
|---|---|---|---|
| 2,996,180 | 8/1961 | Bruce | 206/430 |
| 3,305,085 | 2/1967 | Rossi | 206/150 |
| 3,822,012 | 7/1974 | Weaver | 206/151 |
| 3,923,155 | 12/1975 | Tanzer | 206/427 |
| 4,191,290 | 3/1980 | Suffern | 206/150 |
| 4,403,689 | 9/1983 | Wood | 206/427 |
| 4,465,180 | 8/1984 | Klygis | 206/151 |
| 4,756,419 | 7/1988 | Le Bras | 206/430 |
| 4,930,633 | 6/1990 | Gloyer | 206/427 |
| 4,974,726 | 12/1990 | Klygis et al. | 206/158 |
| 5,246,113 | 9/1993 | Schuster | 206/430 |

FOREIGN PATENT DOCUMENTS

| | | | |
|---|---|---|---|
| 1319902 | 6/1973 | United Kingdom | 206/427 |
| 9012742 | 11/1990 | WIPO | 206/150 |

*Primary Examiner*—David T. Fedei
*Attorney, Agent, or Firm*—Schwartz & Weinrieb

[57] ABSTRACT

In a novel, unitized package having an upper tier and a lower tier, each tier comprises substantially identical containers, such as beverage cans of a type having a chime at an upper end, arranged in a substantially rectangular array, and a carrier made from a single sheet of resilient polymeric material, such as low density polyethylene. A covering sheet and a second covering or dividing sheet are employed, each being made from a paperboard material. The covering sheet is folded so as to form a cover panel, which covers the upper ends of the containers of the upper tier, and two lateral panels, which extend downwardly from the cover panel, along and below the containers of the upper tier, and along the containers of the lower tier. The cover panel of the covering sheet has slots for receiving portions of the chimes of the containers of the upper tier. The dividing sheet is folded so as to form a divider panel, which covers the upper ends of the containers of the lower tier, and two lateral flaps, which extend downwardly between the lateral panels of the covering sheet and the containers of the lower tier. The divider panel of the dividing sheet may have slots like those of the cover panel of the covering sheet. The lateral panels of the covering sheet are affixed adhesively to the carriers of the respective tiers and to the lateral flaps of the dividing sheet.

22 Claims, 1 Drawing Sheet

PACKAGE COMPRISING CONTAINERS IN UNITIZED UPPER AND LOWER TIERS

TECHNICAL FIELD OF THE INVENTION

This invention pertains to a novel package comprising substantially identical containers, such as beverage cans of a type having a chime at an upper end, in unitized upper and lower tiers. A covering sheet, which helps to unitize the upper and lower tiers, provides expansive surfaces for pricing, barcoding, and other labelling of the novel package.

BACKGROUND OF THE INVENTION

Commonly, beverage cans of the type noted above are marketed in packages comprising four, six, eight, or twelve cans arranged in substantially rectangular arrays and retained in machine-applied carriers made from single sheets of resilient polymeric material, such as low density polyethylene. The carriers are made, as by die-cutting, so as to have band segments defining container-receiving apertures.

As exemplified in Klygis et al. U.S. Pat. No. 4,974,726, it is known to cover such cans with a separate sheet, which is clipped onto the cans to enhance such a package. A package of related interest is disclosed in Suffern U.S. Pat. No. 4,191,290.

Since shelf space in a modern supermarket must be strictly allocated among a great diversity of different products, it has been proposed to stack one such package comprising four or six cans on a like package and to sell the stacked packages as a unitized package.

When beverage cans are stacked on one another, one concern that must be addressed is that the lower ends of the upper cans tend to interlock with the upper ends of the lower cans, particularly if pull tabs are provided on the upper ends of the respective cans.

A need has arisen, to which this invention is addressed, for an effective way to unitize such stacked packages.

SUMMARY OF THE INVENTION

This invention provides a novel package comprising substantially identical containers, such as beverage cans of the aforenoted type having a chime at an upper end, in an upper tier and a lower tier. Each tier comprises such containers in a substantially rectangular array, such as a substantially square array of four containers.

Each tier comprises a carrier made from a single sheet of resilient polymeric material, such as low density polyethylene, so as to have band segments defining container-receiving apertures. The carrier is applied to the containers of such tier so that the containers thereof are received by the container-receiving apertures and so that the band segments embrace the side walls of the containers of such tier.

Further, the novel package comprises a covering sheet, which is folded so as to form a cover panel and two lateral panels. The cover panel covers at least a substantial part of at least some of the containers of the upper tier. Each lateral panel extends downwardly from the cover panel, along and below adjacent ones of the containers of the upper tier, and along adjacent ones of the containers of the lower tier at least as far down as the carrier of the lower tier.

Each lateral panel is affixed adhesively or otherwise to at least one of the band segments of the carrier of the lower tier so as to unitize the upper and lower tiers.

Each lateral panel may be similarly affixed to at least one of the band segments of the carrier of the upper tier as well as to at least one of the band segments of the carrier of the lower tier.

Preferably, the novel package further comprises a dividing sheet, which is folded to form a divider panel and two lateral flaps. The divider panel is interposed between the containers of the upper tier and the containers of the lower tier and covers at least a substantial part of at least some of the containers of the lower tier.

The lateral flaps extend vertically from the dividing panel, between the lateral panels of the covering sheet and adjacent ones of the containers of one of the upper and lower tiers. Preferably, the lateral flaps extend downwardly between the lateral panels of the covering sheet and adjacent ones of the containers of the lower tier. The lateral panels of the covering sheet are affixed adhesively to the lateral flaps of the dividing sheet.

If each container has a chime at an upper end of such container, the cover panel of the covering sheet may have slits receiving portions of the chimes at the upper ends of at least some of the containers of the upper tier. Moreover, the divider panel of the dividing sheet may have slits receiving portions of the chimes at the upper ends of at least some of the containers of the lower tier.

Preferably, the covering and dividing sheets are made from a paperboard material. As an additional feature of the unitary package, a handle may be attached to the cover panel of the covering sheet.

BRIEF DESCRIPTION OF THE DRAWINGS

These and other objects, features, and advantages of this invention will be evident from the following description of a preferred embodiment of this invention with reference to the accompanying drawings, wherein like reference characters designate like or corresponding parts throughout the several views, and wherein:

In FIG. 3, two lateral panels of a covering sheet are shown being folded downwardly, as the unitized package is being assembled.

DETAILED DESCRIPTION OF PREFERRED EMBODIMENT

Figure 1:
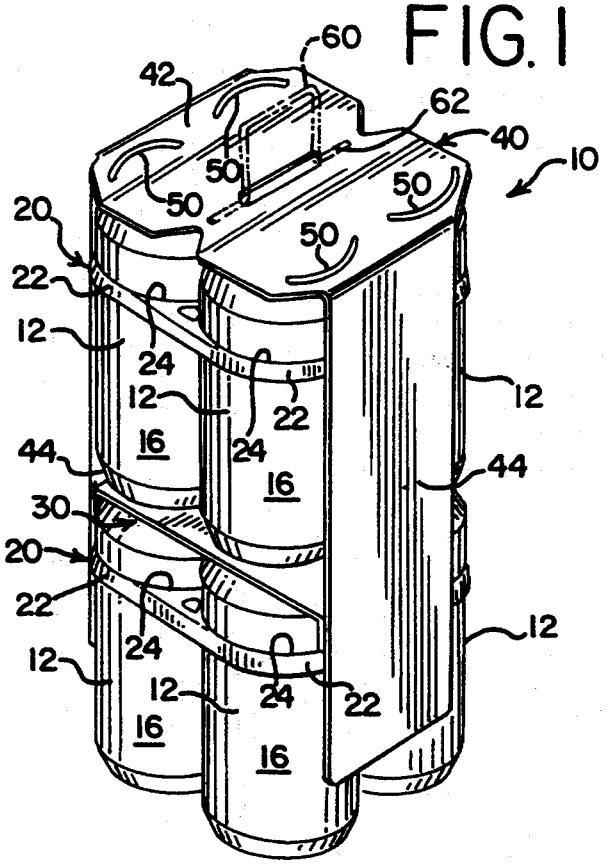
FIG. 1 is a perspective view of a unitized package comprising four containers in an upper tier and four containers in a lower tier and embodying this invention.
Figure 2:
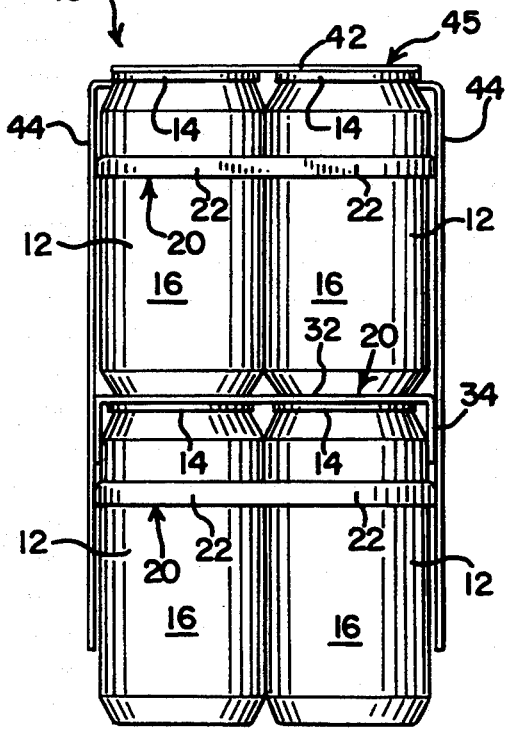
FIGS. 2 and 3 are elevational views of one end of the unitized package.
Figure 3:
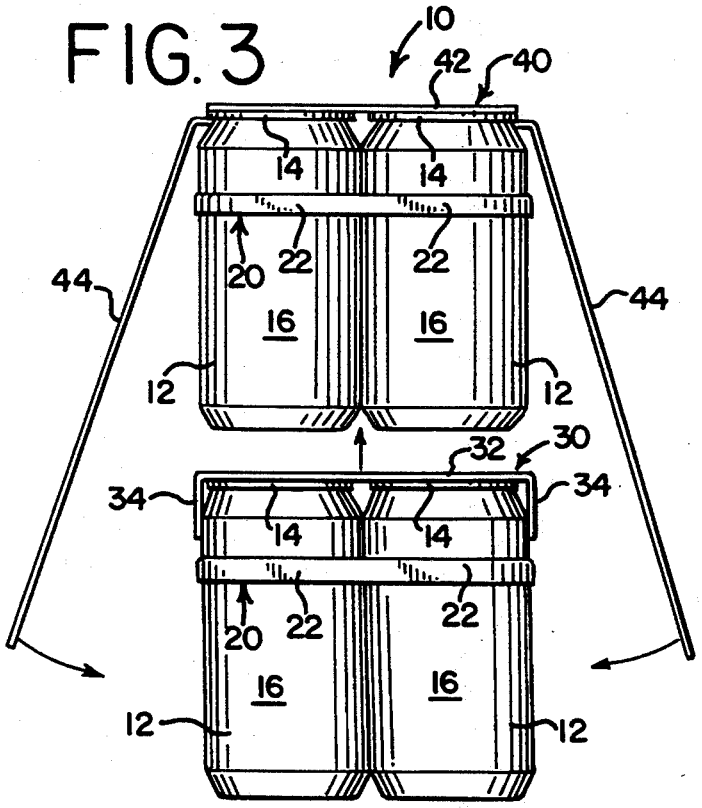

As shown, a unitized package 10 comprising four containers 12 in a substantially square array, in an upper tier, and four containers 12 in a substantially square array, in a lower tier, constitutes a preferred embodiment of this invention. The containers 12 are substantially identical beverage cans of the aforenoted type, each having a chime 14 at an upper end and each having a side wall 16, which is substantially cylindrical.

Each tier comprises a carrier 20 made, as by die cutting, from a single sheet of resilient polymeric material, such as low density polyethylene, so as to have band segments 22 defining container-receiving apertures 24. Any of various known carriers made from carrier stock available commercially from ITW Hi-Cone (a division of Illinois Tools Works Inc.) of Itasca, Ill., may be suitably used as the carrier 20 of each tier.

Each carrier 20 is applied to the containers 12 of the tier comprising such carrier 20, as by known machinery, so that the container-receiving apertures 24 of such carrier 20 receive the respective containers 12 and so that the band segments 22 embrace the side walls 16 of the respective containers 12. Suitable carrier-applying machinery is available commercially from ITW Hi-Cone, supra.

The unitized package 10 comprises a dividing or covering sheet 30, which is folded to form a divider panel 32 and two lateral flaps 34, and a covering sheet 40, which is folded to form a cover panel 42 and two lateral panels 44. The dividing sheet 30 and the covering sheet 40 are made, as by die-cutting, from a paperboard material.

The divider panel 32 of the dividing sheet 30 is interposed between the lower ends of the containers 12 of the upper tier and the upper ends of the containers 12 of the lower tier and covers substantially all of the upper ends of the containers 12 of the lower tier. The lateral flaps 34 of the dividing sheet 30 extend downwardly from the divider panel 32 thereof, along adjacent ones of the containers 12 of the lower tier, and terminate above the carrier 20 of the lower tier.

The cover panel 42 of the covering sheet 40 is disposed so as to cover substantially all of the upper ends of the containers 12 of the upper tier. The lateral panels 44 of the covering sheet 40 extend downwardly from the cover panel 42 thereof, along and below the lateral flaps 34 of the dividing sheet 30 and adjacent ones of the containers 12 of the lower tier, and along and below the carrier 20 of the lower tier. The lateral flaps 34 of the dividing sheet 30 are interposed between the lateral panels 44 of the covering sheet 40 and adjacent ones of the containers 12 of the lower tier.

The lateral panels 44 of the covering sheet 40 are affixed adhesively to the carrier 20 of the upper tier, to the lateral flaps 34 of the dividing sheet 30, and to the carrier 20 of the lower tier, so as to unitize the upper and lower tiers. The lateral panels 44 are affixed adhesively to the respective carriers 20 at the band segments 22 embracing outer portions of the side walls 16 of the respective containers 12.

As shown, the cover panel 42 of the covering sheet 40 has arcuate slits 50, which receive outer portions of the chimes 14 at the upper ends of the containers 12 of the upper tier. The divider panel 32 of the dividing sheet 30 may have similar slits (not shown) receiving outer portions of the chimes 14 at the upper ends of the containers 12 of the lower tier.

Alternatively, except as illustrated and described herein, the divider panel 32 of the dividing sheet 30 and the cover panel 42 of the covering sheet 40 may be substantially similar to the clip-on sheet illustrated and described in Klygis et al. U.S. Pat. No. 4,974,726, the disclosure of which is incorporated by reference. As compared to the longitudinal edge portions of the clip-on sheet illustrated and described therein, the lateral flaps 34 of the dividing sheet 30 extend downwardly at generally right angles, for a slightly greater distance, so as to permit the lateral panels 44 of the covering sheet 40 to be adhesively affixed to the lateral flaps 34. As compared thereto, the lateral panels 44 of the covering sheet 40 extend downwardly at generally right angles, for a substantially greater distance, so as to permit the lateral panels 44 to be adhesively affixed to the carrier 20 of the lower tier.

As shown in dashed lines in FIG. 1, a plastic or wire handle 60 may be attached to the cover panel 42 of the covering sheet 40, at an elongate slot 62 provided in the cover panel 42.

Advantageously, the dividing sheet 30 not only helps to unitize the upper and lower tiers but also divides the containers 12 of the respective tiers, so as to offset any tendencies of the lower ends of the containers 12 of the upper tier to interlock with the upper ends of the containers 12 of the lower tier, even if pull tabs (not shown) are provided at the upper ends of the respective containers 12.

Advantageously, the covering sheet 40 not only helps to unitize the upper and lower tiers but also provides expansive surfaces on the cover panel 42 and the lateral panels 44 for pricing, barcoding, and other labelling of the unitized package 10.

Although each tier has four containers 12 in the preferred embodiment described above, each tier may have a different number of such containers 12, such as, for example, six containers 12.

Although it is preferred for the covering sheet 40 to be adhesively affixed as and where noted above, the covering sheet 40 may be heat-sealed if suitable coatings or suitable materials are employed.

Various other modifications may be made in the preferred embodiment described above without departing from the scope and spirit of this invention. It is therefore to be understood that within the scope of the appended claims, the present invention may be practiced otherwise than as specifically described herein.

I claim:

1. A unitized package, comprising:

a plurality of substantially identical containers having upper and lower ends and side walls, and arranged in an upper tier and a lower tier; each tier comprising a plurality of such containers disposed in a substantially rectangular array, and a carrier comprising a single sheet of resilient polymeric material so as to have band segments defining container-receiving apertures with said carrier being applied to said containers of said tier so that said containers are received by said container-receiving apertures and so that said band segments embrace said side walls of said containers said tier;

a covering sheet folded so as to form a cover panel and two lateral panels, said cover panel covering at least a substantial part of said upper ends of at least some of said containers of said upper tier, and each lateral panel extending downwardly from said cover panel so as to extend along and below adjacent ones of said containers of said upper tier, and along adjacent ones of said containers of said lower tier at least as far down as said carrier of said lower tier, so as to be disposed externally of said substantially rectangular arrays of containers disposed within said upper and lower tiers; and means for fixing each lateral panel to at least one of said band segments of said carrier of said lower tier so as to unitize said upper and lower tiers of said package.

2. The package of claim 1 wherein each lateral panel is affixed adhesively to at least one of the band segments of the carrier of the upper tier as well as to at least one of the band segments of the carrier of the lower tier.

3. The package of claim 2 wherein each container has a chime at an upper end of said container and wherein the cover panel of the covering sheet has slots for receiving portions of the chimes at the upper ends of at least some of the containers of the upper tier.

4. The package of claim 2 further comprising a dividing sheet comprising a divider panel and two lateral flaps, the divider panel being interposed between the lower ends of the containers of the upper tier and the upper ends of the containers of the lower tier and covering at least a substantial part of the upper ends of at least some of the containers of the lower tier, the lateral flaps extending vertically from the divider panel, between the lateral panels and adjacent ones of the containers of one of the upper and lower tiers, the lateral panels being affixed adhesively to the lateral flaps.

5. The package of claim 4 wherein the lateral flaps extend downwardly from the divider panel, between the lateral panels and adjacent ones of the containers of the lower tier.

6. The package of claim 4 wherein each container has a chime at an upper end of said container and wherein the cover panel of the covering sheet has slots for receiving portions of the chimes at the upper ends of at least some of the containers of the upper tier.

7. The package of claim 6 wherein the divider panel of the dividing sheet has slots for receiving portions of the chimes at the upper ends of at least some of the containers of the lower tier.

8. The package of claim 4 wherein the covering and dividing sheets are made from a paperboard material.

9. The package of claim 1 further comprising a handle affixed to the cover panel of the covering sheet.

10. A unitized package, comprising:

a plurality of substantially identical containers having upper and lower ends and side walls, and arranged in an upper tier and a lower tier; each tier comprising a plurality of said containers disposed in a substantially rectangular array, and a carrier comprising a single sheet of resilient polymeric material so as to have band segments defining container-receiving apertures with said carrier being applied to said containers of each tier so that said containers are received by said container-receiving apertures and so that said band segments embrace said side walls of said containers of said tier;

a covering sheet folded so as to form a cover panel and two lateral panels, said cover panel covering at least a substantial part of said upper ends of at least some of said containers of said upper tier, and each lateral panel extending downwardly from said cover panel so as to extend along and below adjacent ones of said containers of said upper tier, and along adjacent ones of said containers of said lower tier at least as far down as said carrier of said lower tier;

a second covering sheet interposed between said lower ends of said containers of said upper tier and said upper ends of said containers of said lower tier for covering and gripping at least a substantial part of said upper ends of at least some of said containers of said lower tier;

means for fixing said second covering sheet to at least one of said lateral panels of said covering sheet; and means for fixing each one of said lateral panels of said covering sheet to at least one of said band segments of said carrier of said lower tier so as to unitize said upper and lower tiers of said package.

11. The package as set forth in claim 1, wherein:

each one of said carriers of said upper and lower tiers comprises polyethylene.

12. The package as set forth in claim 10, wherein:

each one of said carriers of said upper and lower tiers comprises polyethylene.

13. The package as set forth in claim 10, wherein:

said second covering sheet extends transversely across said package between said lateral panels of said covering sheet, and comprises lateral flaps upon opposite ends of said second covering sheet for facilitating attachment of said second covering sheet to at least one of said lateral panels of said covering sheet.

14. The package as set forth in claim 10, wherein:

each one of said containers of said lower tier comprises a chime member upon said upper end of said each one of said containers; and said second covering sheet comprises slots for receiving portions of said chime members of said upper ends of at least some of said containers of said lower tier.

15. The package as set forth in claim 10, further comprising:

means for fixing each one of said lateral panels of said covering sheet to at least one of said band segments of said carrier of said upper tier.

16. The package as set forth in claim 15, wherein:

said means for fixing each one of said lateral panels of said covering sheet to said at least one of said band segments of said carriers of said upper and lower tiers comprises an adhesive.

17. The package as set forth in claim 13, wherein:

said means for fixing said second covering sheet to said at least one lateral panel of said covering sheet comprises an adhesive.

18. The package as set forth in claim 10, wherein:

said covering sheet and said second covering sheet comprise paperboard.

19. A unitized package, comprising:

a plurality of substantially identical containers having upper and lower ends and side walls, and arranged in an upper tier and a lower tier; each tier comprising a plurality of said containers disposed in a substantially rectangular array, and a carrier comprising a single sheet of resilient polymeric material so as to have band segments defining container-receiving apertures with said carrier being applied to said containers of said tier so that said containers are received by said container-receiving apertures and so that said band segments embrace said side walls of said containers of said tier;

a unitizing sheet folded so as to form a cover panel, a first lateral panel, and a second lateral panel; said cover panel covering at least a substantial part of said upper ends of at least some of said containers of said upper tier; and each lateral panel extending downwardly from said cover panel along and below adjacent ones of said containers of said upper tier, and along adjacent ones of said containers of said lower tier at least as far down as said carrier of said lower tier;

a divider panel interposed between said lower ends of said containers of said upper tier and said upper ends of said containers of said lower tier;

means for attaching said divider panel to at least one of said first and second lateral panels; and means for attaching each one of said first and second lateral panels to at least one of said band segments of said carrier of said lower tier so as to unitize said upper and lower tiers of said package.

20. The package as set forth in claim 19, wherein:

said divider panel extends transversely across said package between said first and second downwardly extending lateral panels; and said divider panel comprises a pair of end flaps provided upon opposite ends of said divider panel for enabling attachment of said divider panel to said lateral panels.

21. The package as set forth in claim 19, wherein:

said carriers of said upper and lower tiers comprise polyethylene.

22. The package as set forth in claim 19, wherein:

said unitizing sheet and said divider panel comprise paper-board.

* * * * *